United States Patent [19]

Medendorp

[11] 4,146,170

[45] Mar. 27, 1979

[54] CONTAINER COVER

[75] Inventor: Roger L. Medendorp, Grand Rapids, Mich.

[73] Assignee: Carrigan Plastics, Inc., Grand Rapids, Mich.

[21] Appl. No.: 769,444

[22] Filed: Feb. 17, 1977

[51] Int. Cl.[2] ..... B65D 43/10; B65D 11/10

[52] U.S. Cl. ..... 229/43; 206/519; 220/307

[58] Field of Search ..... 229/43; 220/306, 4 B, 220/4 E; 150/0.5; 206/519, 508, 520

[56] References Cited

U.S. PATENT DOCUMENTS

| | | | |
|---|---|---|---|
| 2,990,998 | 7/1961 | Barclay | 229/43 |
| 3,055,540 | 9/1962 | Ringlen | 229/43 X |
| 3,326,408 | 6/1967 | Ringlene | 220/307 |
| 3,460,711 | 8/1969 | Al-Roy | 206/519 X |
| 3,620,403 | 11/1971 | Rump | 229/2.5 |
| 3,795,360 | 3/1974 | Bianchi et al. | 229/43 |
| 3,837,526 | 9/1974 | Medendorp | 229/43 X |
| 3,912,118 | 10/1975 | Bird | 229/43 |

*Primary Examiner*—Davis T. Moorhead

*Attorney, Agent, or Firm*—Price, Heneveld, Huizenga & Cooper

[57] ABSTRACT

A rectangular container cover includes sidewalls having an intermediate, horizontally extending ledge and downwardly depending end segment shaped to fit over a peripheral rim of a container such that the horizontal ledge is in abutment with the container lip. The cover is made of a flexible material with detents provided for releasably attaching the cover to a container near each of the corners. The corners of the cover have a radius of curvature greater than the radius of curvature of the container on which the cover is adapted to fit such that when positioned on the container, the sides of the cover are in tension and snugly fit against the associated container.

8 Claims, 5 Drawing Figures

CONTAINER COVER

BACKGROUND OF THE INVENTION

The present invention relates to container covers and in particular to flexible covers with improved means for securing the cover to a container.

In the packaging of consumable articles and particularly items such as cakes, biscuits or the like, it is desirable that they be packaged in a manner to assure the freshness of the item. Thus it is desired that they be reasonably well sealed and not inadvertently removed. With articles such as cakes, breakfast rolls or the like which may include frosting or other coatings for taste as well as ornamentation, it is desired that the packaging does not contact the frosting or coating which would cause its mutilation when opening the packaging. Further, it is desired to package such items in a transparent display to visibly promote the product therein.

In order to meet these requirements, in the past cake tins typically made of an aluminum foil tray having a rolled edge for strength have been covered with a flexible, transparent plastic cover made of, for example, polystyrene which extends over the edge of the tray holding the cover on the tray and yet permitting relatively easy removal of the cover. The problem, particularly with relatively large-size, rectangular trays, is that the relatively lengthy sidewalls of the container cover easily bulge outwardly and form an imperfect seal between the cover and the associated tray. This failure of prior at devices to securely seal the container causes rapid drying of the product thereby losing its freshness and saleability.

The prior art includes various closure devices typically having multiple engaging surfaces for assuring a tight seal between a container and its cover. Such prior art is perhaps best represented by U.S. Pat. No. 3,055,540 issued Sept. 25, 1962, to A. Ringlen. In this patent, the container and its cover include several mating, angled surfaces. The container is specially curved to provide a compressive fitting between the cover and the container. Although such prior art devices provide the desired sealing important in the environment of the present application, to achieve this sealing effect the lid and the container itself must be specially manufactured so that they have correspondingly mating, sealing surfaces. It is desirable, therefore, to provide a container cover which will fit with a standard aluminum foil tray or container without modification and yet prevent inadvertent removal and provide the desired sealing not obtainable by known prior art covers for such trays. Since these trays tend to differ in manufactured size tolerances, it is desired also to provide a cover which will accommodate such variations and provide a locking fit for the cover on a given size tray.

SUMMARY OF THE INVENTION

The present invention overcomes the deficiencies of the prior art by providing a container cover made of a flexible, transparent polymeric material of polygonal configuration corresponding to that of a container for which the cover is adapted. The container cover includes a top and integral sidewalls with an intermediate, horizontally extending ledge adapted to rest on the lip of an associated container. The cover sidewalls integrally include a downwardly extending peripheral wall segment extending below the lip of the container. One or more of the corners of the container cover have a radius of curvature significantly greater than that of the container itself such that when the cover is placed over the associated container, the adjacent sidewalls will be drawn tightly against the container lip thereby effecting a seal between the container cover and a container.

These and other features, advantages and objects of the present invention will become readily apparent upon reading the following description thereof together with the accompanying drawings in which:

DETAILED DESCRIPTION OF THE PREFERRED EMBODIMENT

Figure 1:
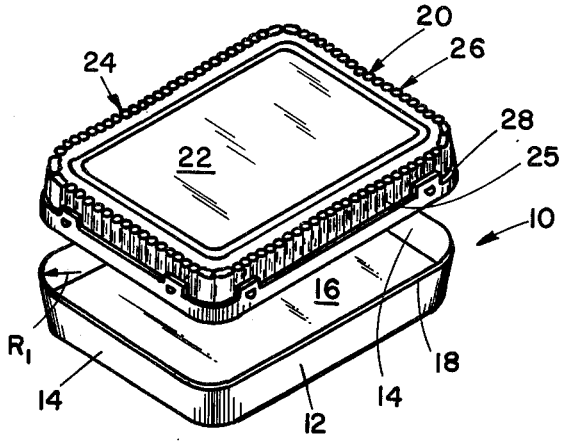
FIG. 1 is a perspective view of a container and a cover construction according to the present invention.
Figure 5:
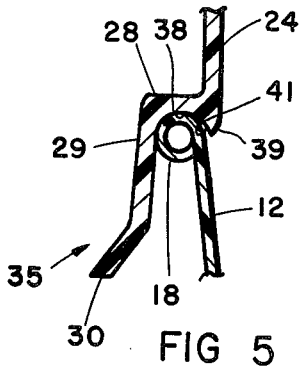
FIG. 5 is a fragmentary cross section taken along section lines V—V of FIG. 4.
Figure 2:
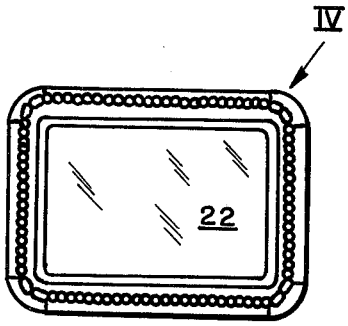
FIG. 2 is a plan view of the cover positioned on the container.

Referring now to the FIGS. and specifically to FIG. 1 there is shown a tray 10 and associated cover 20 which is constructed according to the present invention. Tray 10 is a commercially available, polygonal tray made of preformed sheet aluminum. In the preferred embodiment, tray 10 is generally rectangular having sidewalls 12, endwalls 14, a floor 16 and an outwardly rolled rim 18 (as best seen in FIG. 5). In the embodiment shown, the tray is a standard-size cake tray having outer dimensions of approximately 9 inches by 13 inches, and a depth of approximately 1 inch. The corners of the pan 10 are generally rounded with a radius of curvature $R_1$ in the preferred embodiment of 0.9563 inches. Rolled edge 18 extends around the periphery of the top of the tray 10 forming a lip with a support surface thereunder as well as an upper supporting surface for the cover 20.

Cover 20 is integrally molded of a biaxially oriented polystyrene having a thickness of approximately 0.0125 inches although other generally, flexible polymeric materials of varying thicknesses can be employed. Preferably, the cover is transparent permitting the consumer to view the contents of container 10. The cover includes a top 22, downwardly depending sidewalls 24 and endwalls 26. The walls each include a plurality of curved convolutions 5 adding strength and rigidity to the downwardly depending walls. The rounded convolutions have a diameter of approximately $\frac{3}{8}$ of an inch in the preferred embodiment.

The side and end walls include an intermediate, horizontally extending ledge 28 extending outwardly from the bottom of the convolutions 25 approximately $\frac{1}{8}$-$\frac{1}{4}$ inch forming a scalloped seating surface 38 resting against the top of rim 18 of the tray. Extending downwardly from ledge 28 is a downwardly depending flange 29 having a height of approximately 9/16 of an inch in the preferred embodiment. The downwardly depending flange 29 has a slightly, outwardly flared bottom edge 30 facilitating the fitting of cover 20 over the tray 10. Thus, the perimeter of edge 30 is slightly greater than that of lip 18 on the tray but decreases vertically, upwardly toward ledge 28 until the perimeter of flange 29 is slightly smaller or approximately the same size as that of the associated tray. Having briefly described the overall cover construction, a detailed examination of the unique corner construction built according to the present invention is now presented in detail with reference specifically to FIGS. 3–5.

Figure 4:
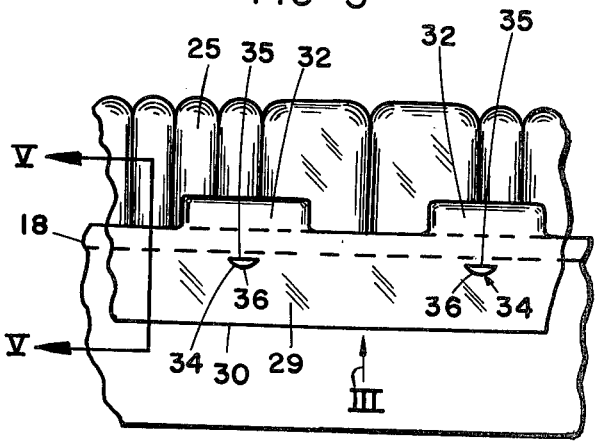
FIG. 4 is an enlarged side elevational view of one of the corners taken from the direction of arrow IV in FIG. 2.
Figure 3:
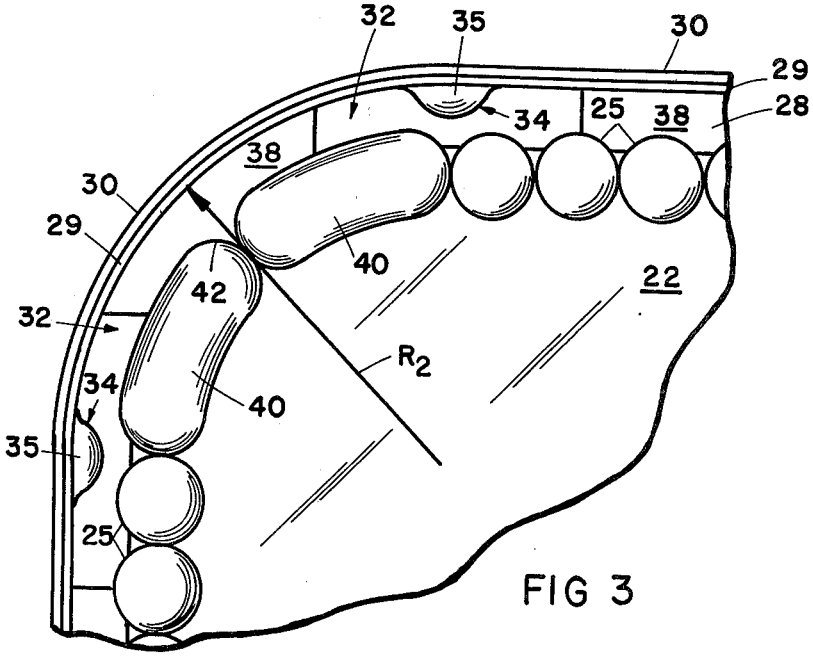
FIG. 3 is a greatly enlarged bottom plan view of one of the corners of the cover shown in FIGS. 1 and 2 from the direction of arrow III in FIG. 4.

As best seen in FIGS. 1, 3 and 4, the horizontally extending ledge of cover 20 includes a pair of spaced recesses 32 positioned on opposite corners of adjacent walls at each corner of the cover. Recesses 32 are positioned above and provide clearance for a pair of similarly positioned locking dimples 34 formed inwardly on the upper portion of flange 29 approximately 1 inch from the center of each of the corners.

Each of the dimples constitutes a flattened, semi-circular seating surface 35 gripping the under edge of lip 18 and a semi-hemispherical body 36 thereunder permitting the dimples to be easily snapped over the lip 18 of tray 10 in a camming fashion. The distance between the top surface 35 of the dimples 34 and the bottom surface 38 of ledge 28 is approximately equal to the diameter of the rounded lip 18 on the tray so as to securely grip the lip between the eight dimples (two on each corner) and bottom surface 38 of ledge 28 of the cover. Recesses 32 provide the desired clearance for deflecting the corners of the tray downwardly until the cam action dimples snap over the edge of lip 18 providing a tight compression fit of the cover over the lid.

Spaced at predetermined intervals along the sidewalls and end walls of the cover 20, as best seen in FIG. 5, are plurality of integrally formed, tapered projections 39 which extend downwardly from the walls 24 and 26 of the tray 10. The flange 29 and projection 39 together with ledge 28 form a generally U-shaped construction which circumscribes a portion of the circular rolled edge 18 of the tray 10 thereby snugly holding the tray cover to the tray around the periphery of the junction of a cover and tray. The projection 39 has a tapered outer surface 41 promoting the camming of the projection over lip 18 into the position shown in FIG. 5.

It is noted that the downwardly tapered projections 39 span single corrugations 25 at spaced intervals to one another as opposed to being continuous. This facilitates insertion of the cover along its entire length without having the cover slip out and with minimal disturbance of the frosting when, for example, the container is used for a frosted cake.

In order to hold the sidewalls 24 and 26 tightly adjacent the lip 18 of the tray, the radius $R_2$ of the rounded corners of the polygonal cover are shaped to be slightly greater than the radius $R_1$ of the tray. Thus in the preferred embodiment, the radius of the cover was selected to be 0.9375 inches. This slight flattening of the corners of the cover causes the sidewalls to be placed in tension as the cover is inserted over the tray thereby pulling the sidewalls and particularly the flange 29 securely against the lip 18 of the tray. In the preferred embodiment, all of the corners were so dimensioned although in some embodiments at least two corners so formed may be sufficient. Although the difference in diameter of the preferred embodiment represents approximately 2.5 percent increase in radius of the cover as compared to the radius of curvature of the corner of the associated tray, the range of approximately 1–7 percent is usable and the range of 2–5 percent has been found to be most effective. If the corners of the cover and container are not rounded but intersect at an angle, the angle of intersection of the cover sidewalls can be greater than that of the container to provide the same desirable results.

In order to strengthen the corners, arcuate-shaped convolutions 40 are provided with a downwardly projecting tip 42 therebetween having a configuration that is substantially identical to the projections 39 to cause the corner to also grip the corner of lip 18 of tray 10 in a manner similar to that shown in the FIG. 5 sidewall area. By providing this unique corner construction in which the radius of curvature of the cover is greater than that of the associated tray, the sidewalls of the cover are drawn tightly against the tray thereby effecting an excellent seal between the cover and tray. Similarly, the tapered projections 39 and 42 spaced intermittently along the internal edges of the sidewalls of the tray and at the corners further enhance this sealing action.

It will become apparent to those skilled in the art that various modifications to the preferred embodiment can be made without departing from the spirit and scope of the invention. Thus for example, the tapered projections 39 can be eliminated in some instances and retaining means other than the dimples 34 can also be used to secure the cover to the tray. Further, the polygonal tray can be of any size or number of sides and made of a variety of materials so long at it is relatively resilient and flexible permitting the tensioning of the cover sides as it is fitted over the associated tray These and other modifications to the preferred embodiment described and disclosed herein will, however, fall within the scope and spirit of the appended claims.

The embodiments of the invention in which an exclusive property or privilege is claimed are defined as follows.

1. A cover for use with a rectangular container having a peripheral rim, said cover comprising:

a top and integrally formed sidewalls made of a resilient material and having a polygonal shape and approximate size corresponding to that of an associated rectangular container, the junction of at least two adjacent ones of said sidewalls having a substantially curvilinear shape in plan view with a radius of curvature greater than that of an associated container with which it is to be used whereby when said cover is placed on the associated container the cover is adapted to have a force exerted radially outwardly on said junction and said force is transmitted to the sides of said cover placing them in tension and causing them to straighten and resist bowing so as to form a tight fit on the corresponding sides of said container.

2. The cover as defined in claim 1 wherein said sidewalls include an upper generally vertically extending portion, an intermediate generally horizontally extending ledge and a downwardly extending flange on a side of said ledge opposite said upper portion.

3. The cover as defined in claim 2 wherein said flange is interrupted at adjacent edges of each corner of said cover to define a recess and wherein said sidewalls include retaining means positioned directly below each recess so formed.

4. The cover as defined in claim 1 wherein said resilient material comprises biaxially oriented polystyrene.

5. The cover as defined in claim 1 wherein said sidewall junction has a radius of curvature from 1–7 percent greater than the radius of curvature of a corresponding junction of an associated container.

6. A rectangular container and cover comprising:

a rectangular container having sidewalls and a floor, said sidewalls joined at corners having a substantially curvilinear shape in plan view with a predetermined radius of curvature; and a rectangualar cover having a top and integrally formed sidewalls made of a resilient material and having a rectangulr shape and size substantially corresponding to that of said container except that the corner of said cover formed at the junction of at least two adjacent ones of said sidewalls has a radius of curvature greater than that of a corresponding cover of said container whereby when said cover is placed on said container the corner of said container corresponding to said corner of said cover exerts a force on said cover corner in a direction radially outwardly thereof, and such force is transmitted to the said adjacent sides of said cover to place them in tension and cause them to straighten out and form a tight fit on the corresponding sides of said container.

7. The device as defined in claim 6 wherein the radius of curvature of said cover sidewall junction is about 1–7 percent larger than the radius of curvature of said container corners.

8. The device as defined in claim 6 wherein said sidewalls of said cover include a upper portion extending generally vertically, an intermediate portion extending generally horizontally and forming a ledge, and a downwardly extending flange on a side of said ledge opposite said upper portion, said flange including at least portions defining a recess for receiving the top edge of the sidewall of the container.

* * * * *